US007114799B2

(12) United States Patent
Huang et al.

(10) Patent No.: US 7,114,799 B2
(45) Date of Patent: Oct. 3, 2006

(54) PRINTING INK DELIVERY CONTROL MECHANISM

(75) Inventors: Pui Wen Huang, Singapore (SG); Seng San Koh, Singapore (SG); Kok Weng Chan, Singapore (SG); Wee Lian Tan, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 306 days.

(21) Appl. No.: 10/888,418

(22) Filed: Jul. 9, 2004

(65) Prior Publication Data

US 2006/0007274 A1 Jan. 12, 2006

(51) Int. Cl.
*B41J 2/17* (2006.01)
*B41J 2/165* (2006.01)

(52) U.S. Cl. ..... 347/84; 347/32

(58) Field of Classification Search ..... 347/32, 347/84, 85; 141/2, 18, 21; 400/664, 668
See application file for complete search history.

(56) References Cited

U.S. PATENT DOCUMENTS 6,106,113 A * 8/2000 Yamazaki et al. ..... 347/103
6,367,908 B1 * 4/2002 Serra et al. ..... 347/37
6,612,689 B1 * 9/2003 Suenaga et al. ..... 347/85
6,749,298 B1 * 6/2004 Schalk et al. ..... 347/104
6,793,316 B1 * 9/2004 Sugimura et al. ..... 347/29

* cited by examiner

*Primary Examiner*—Anh T. N. Vo

(57) ABSTRACT

An embodiment of the invention provides a mechanism for controlling at least one ink transmission module, which controls a supply of ink using received control rotation. The mechanism includes an input, to receive control rotation. The mechanism also includes an output, to selectively transfer the control rotation to the ink transmission module. A control system is also provided to control the selective transfer of the output. The mechanism is moveable into a disengaged configuration by the control system, in which the output does not transfer rotation of the input to the ink transmission module, by a first predetermined sequence of rotations of the input, and into an engaged configuration, in which the output transfers rotation of the input to the ink transmission module, by a second predetermined sequence of rotations of the input.

17 Claims, 5 Drawing Sheets

PRINTING INK DELIVERY CONTROL MECHANISM

FIELD OF THE INVENTION

The present invention relates to mechanisms for use in printers. More particularly, the present invention relates to mechanisms for controlling ink supply in a printer.

BACKGROUND OF THE INVENTION

Generally in inkjet printing, ink is supplied in four different colors in the "CMYK" scheme. These colors are cyan, magenta, yellow and black. Cyan, magenta and yellow are the subtractive primary colors, rather than the additive primary colors of red, green and blue. This means that colors must be subtracted in order to obtain white (the color of the paper), rather than adding colors to obtain white.

It is possible to create black from a combination of the three subtractive colors, by removing all red, blue and green. However, this results in high use of all three color inks, and so the fourth color, black, is added to print cartridges to reduce use of the other three colors.

In general, during home printing, the consumption of black ink is higher than the consumption of the other colors. Therefore, the black ink supply will generally run out first. Once one of the ink colors has run out, generally the black ink supply, the ink cartridge (containing all ink colors) must be replaced. This is because, once one supply is exhausted, air will be drawn from the empty reservoir into the printhead. The printhead can be damaged if too much air is drawn through it. Therefore, when the black ink supply is low, before the supply runs out completely and the cartridge has to be replaced, the printer will enter "limphome" mode. In this mode, the printer does combine the cyan, magenta and yellow colors to produce a black color. In this way, the black ink supply is conserved and the life of the cartridge is extended until one of the color ink reservoirs is empty. However, even in limphome mode, the black ink reservoir of the cartridge is still functioning, and so air may still travel into the printhead when the black ink level is low.

SUMMARY OF THE INVENTION

In brief, the invention provides a mechanism for controlling at least one ink transmission module, which controls a supply of ink using received control rotation. The mechanism includes an input, to receive control rotation. The mechanism also includes an output, to selectively transfer the control rotation to the ink transmission module. A control system is also provided to control the selective transfer of the output. The mechanism is moveable into a disengaged configuration by the control system, in which the output does not transfer rotation of the input to the ink transmission module, by a first predetermined sequence of rotations of the input, and into an engaged configuration, in which the output transfers rotation of the input to the ink transmission module, by a second predetermined sequence of rotations of the input.

BRIEF DESCRIPTION OF THE DRAWINGS

Embodiments of the invention will now be described, purely by way of example, with reference to the accompanying drawings, in which.

DETAILED DESCRIPTION OF A PREFERRED EMBODIMENT OF THE INVENTION

The detailed description set forth below in connection with the appended drawings is intended as a description of exemplary embodiments of the present invention and is not intended to represent the only embodiments in which the present invention can be practiced. The detailed description includes specific details for the purpose of providing a thorough understanding of the present invention. However, it will be apparent to those skilled in the art that the present invention may be practiced without these specific details.

Figure 1A:
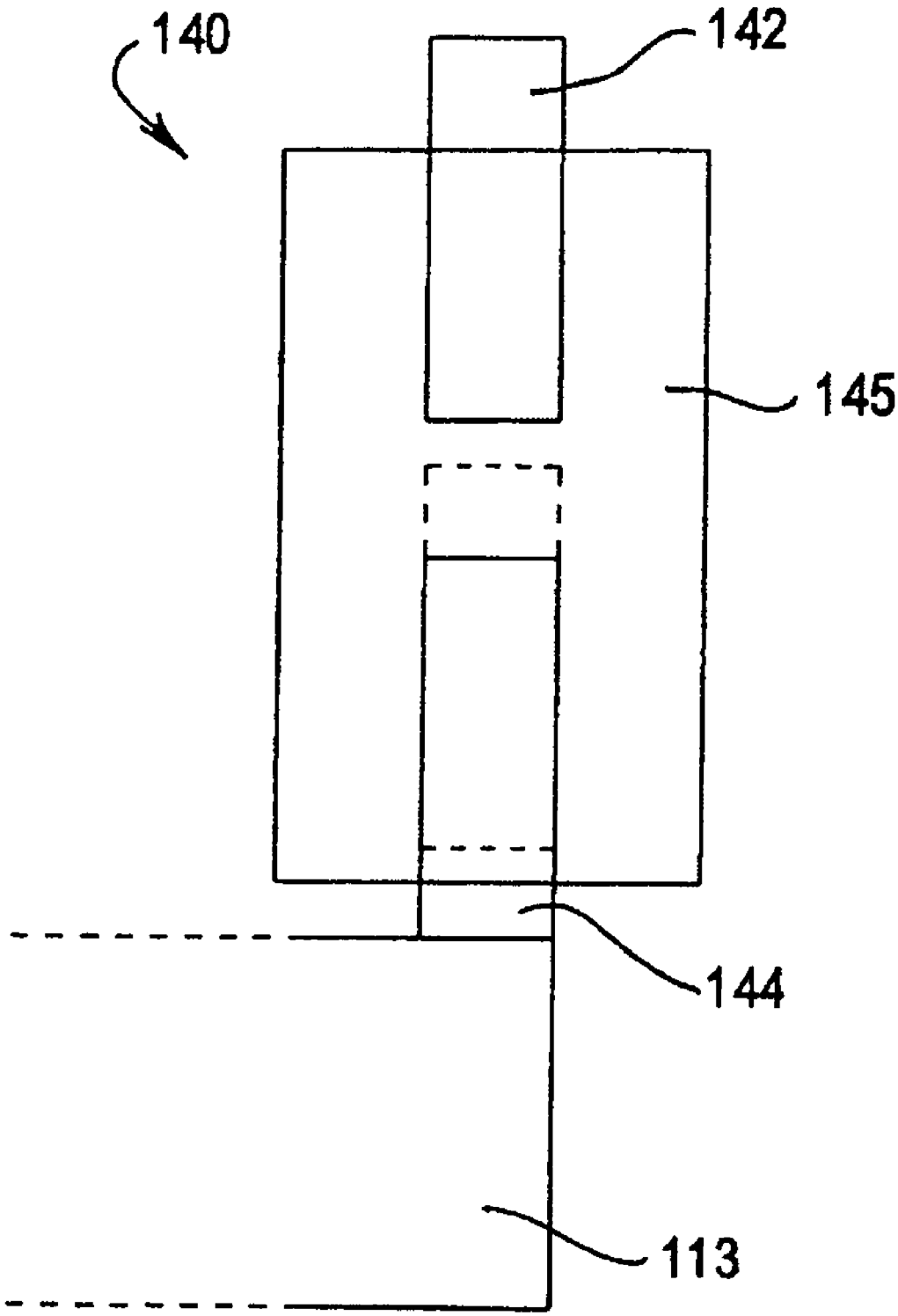
FIG. 1*a* shows a mechanism for controlling an ink supply apparatus according to an embodiment of the invention.

Referring to FIG. 1*a*, a mechanism 140 is shown for controlling at least one ink transmission module 113, which controls a supply of ink using received control rotation. The mechanism 140 includes an input 142, to receive control rotation. The mechanism 140 also includes an output 144, to selectively transfer the control rotation to the ink transmission module 113. A control system 145 is also provided to control the selective transfer of the output 144. The mechanism 140 is moveable into a disengaged configuration by the control system 145, in which the output 144 does not transfer rotation of the input to the ink transmission module 113, by a first predetermined sequence of rotations of the input 142, and into an engaged configuration, in which the output 144 transfers rotation of the input 142 to the ink transmission module 113, by a second predetermined sequence of rotations of the input 142.

Figure 1B:
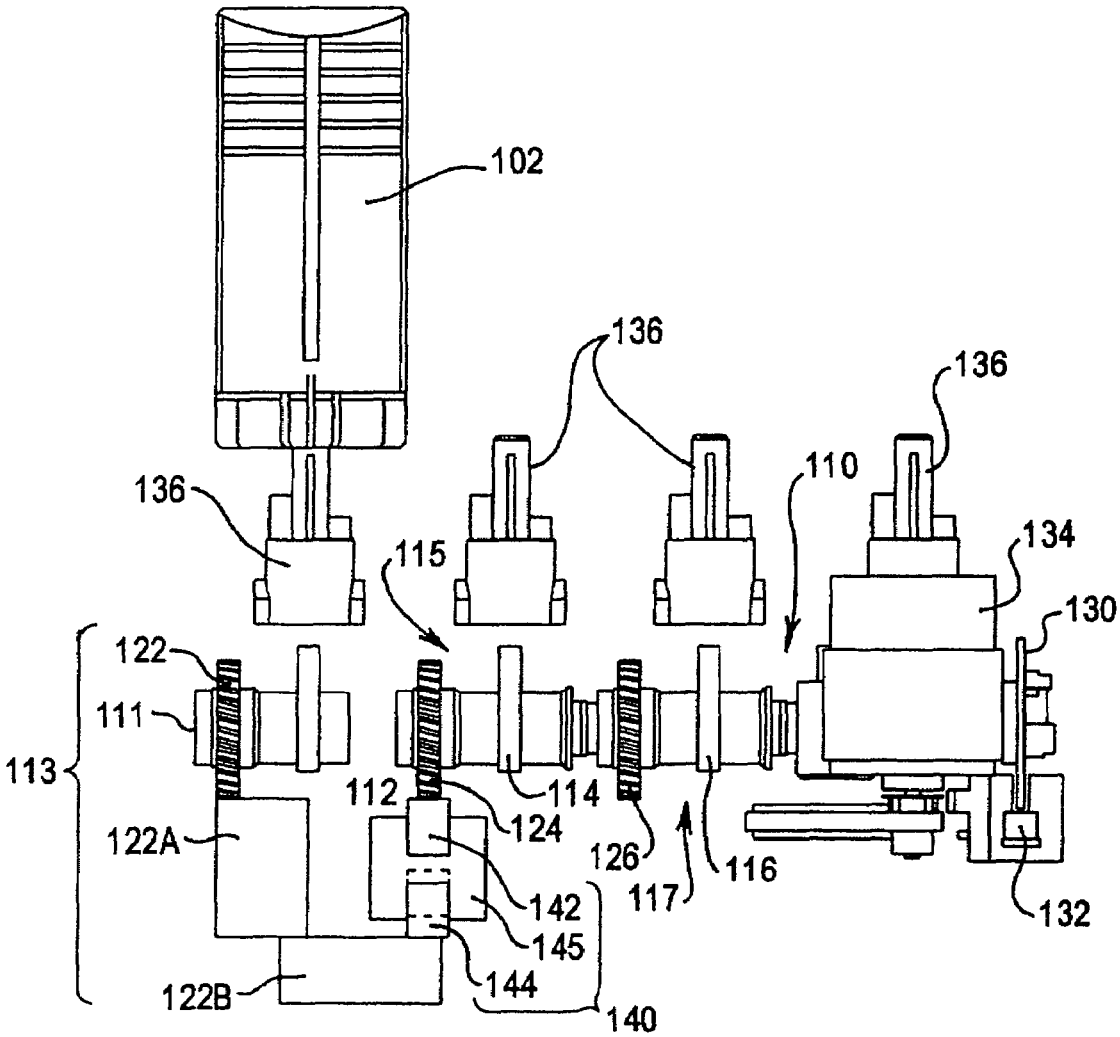
FIG. 1*b* shows a part of an ink supply apparatus for a printer including a mechanism according to an embodiment of the invention.

FIG. 1*b* shows a part of an ink delivery system of a printer according to an embodiment. In the delivery system, four different reservoirs, one for each of the CMYK colors, are provided. In FIG. 1*b*, only the black supply reservoir 102 is shown, for clarity. The ink delivery system includes a first, or color ink control shaft 110, and a second, or black ink control shaft 111. In an embodiment an off centre cam 112 is mounted on the black ink control shaft 111 together with a toothed gear 122, wherein cam 112 and the gear 122 are configured to rotate together. In the present embodiment, the cam 112 and toothed gear 122 together are included in a black ink transmission module 113. The black ink transmission module 113 of this embodiment also includes two idler gears 122A, 122B. The first idler gear 122A is engaged with the toothed gear 122 and has a fixed rotational axis. The second idler gear 122B is engaged with the first idler gear 122A and also has a fixed rotational axis. The second idler gear 122B therefore rotates in the same sense as the black ink control shaft 111.

Three color transmission modules 115, 117, (not shown), made up of three pairs of cams 114, 116, (not shown), and gears 124, 126, (not shown), are mounted on the color ink control shaft 110. In the present embodiment, the colour ink transmission modules do not have idler gears.

An encoder disc 130 is also attached to the color ink control shaft 110, and an encoder disc reader 132 is provided, which accurately reads the rotational position of the encoder disc 130 and outputs information representing the rotational position of the color ink control shaft 110. The color ink control shaft 110 is rotated by a motor 134, mounted transversely to the color ink control shaft 110 and coupled to the color ink control shaft 110 by a belt drive and a worm gear to turn the axis of rotation, through 90°, to that of the color ink control shaft 110.

The system also has an actuator 136, for each reservoir, for opening and closing each reservoir. Looking only at the black ink reservoir 102, the reservoir 102 is activated by rotation of the cam 112 on the black ink control shaft 111, which moves the actuator 136 towards the reservoir 102. This movement provides pressure to a pressure valve (not shown) inside the ink reservoir 102, which opens the reservoir ink supply. The valve is open for as long as the cam 112 is positioned to push the actuator 136 towards the reservoir 102. The other reservoirs are opened and closed in the same way.

The color ink control shaft 110 is attached directly to the motor 134. A first set of transmission modules 115, 117, (not shown), each having one cam 114, 116, (not shown) and one gear 124, 126, (not shown) controls the three color reservoirs. The reservoirs are controlled as described above. A second set of transmission modules, in this embodiment the transmission module 113 for the black ink supply, is mounted on the black ink control shaft 111, which is not directly connected to the motor 134.

The black ink transmission module 113, and therefore the black ink control shaft 111, is coupled to the color ink control shaft 110, and therefore the motor 134, by a selective engagement mechanism 140. The selective engagement mechanism 140 has an input in the form of a toothed input gear 142, which is engaged with the toothed gear 124 of a transmission module 115 mounted on the color ink control shaft 110. The mechanism 140 has an output in the form of a toothed output gear 144 that is movable into and out of engagement with the second idler gear 122B of the black ink transmission module 113 as the selective engagement mechanism 140 is moved between an engaged configuration and a disengaged configuration. The output gear 144 selectively transfers the rotational movement received by the input gear 142 from the color ink control shaft 110 to the black ink transmission module 113. The mechanism 140 also has a control system 145, for controlling the engagement and disengagement of the output gear 144.

When the selective engagement mechanism 140 is in the engaged configuration, the output gear 144 is engaged with the second idler gear 122B of the black ink transmission module 113, and rotation of the motor 134, causes the color ink control shaft 110 and the black ink control shaft 111 to rotate in the same direction by the same angle. The black ink reservoir 102 is therefore opened and closed during rotation of the motor 134. However, when the selective engagement mechanism 140 is in the disengaged position, the output gear 144 is disengaged from the second idler gear 122B of the black ink transmission module 113. While the mechanism 140 is in the disengaged position, rotation of the motor 134, while causing rotation of the color ink control shaft 110, does not cause any rotation of the black ink control shaft 111. The black ink control shaft 111 remains in the rotational position in which it was when the output gear 144 of the selective engagement mechanism 140 was disengaged. Therefore, if the black ink reservoir 102 is closed when the output gear 144 is disengaged, the reservoir 102 remains closed, despite rotation of the motor 134. The black ink reservoir 102 remains closed until the mechanism 140 is reengaged, as described below, and the output gear 144 reengages with the transmission module 113 of the black ink supply.

In the present embodiment, the mechanism 140 and ink transmission modules are arranged so that when the mechanism 240 is engaged, one revolution of the color ink control shaft 110 corresponds to one revolution of the black ink control shaft 111.

Figure 2A:
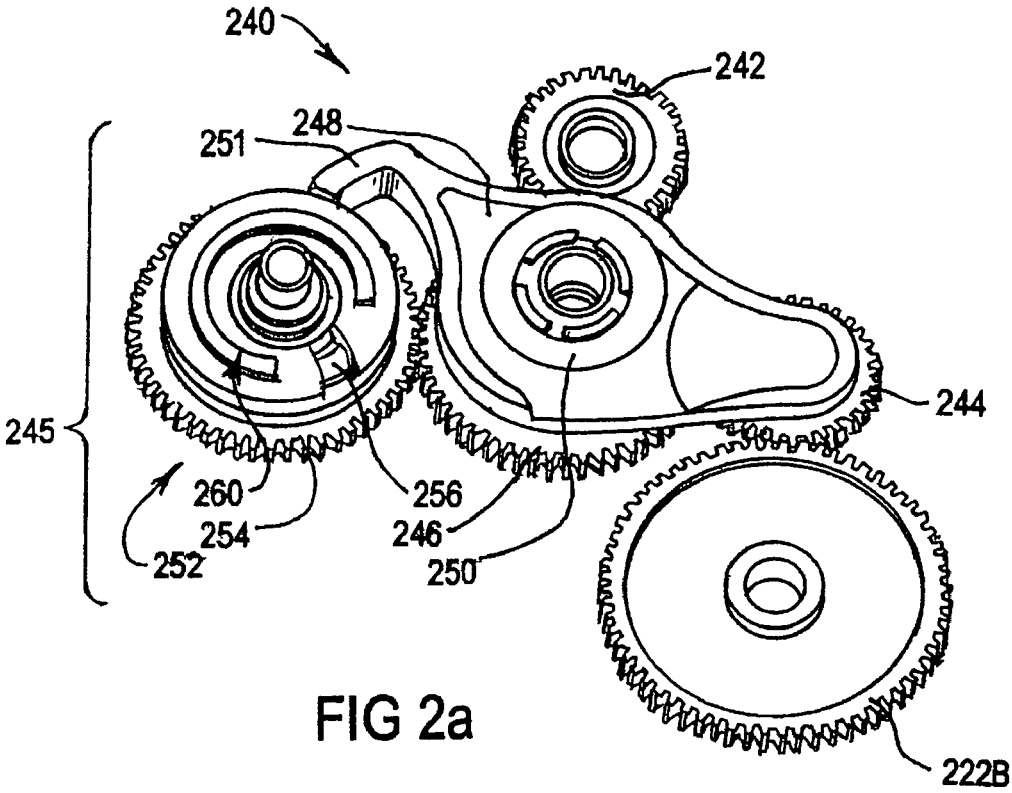
FIG. 2*a* shows detail of the mechanism of an embodiment of the invention in a first configuration.

FIG. 2*a* shows a part of a selective engagement mechanism 240 according to an embodiment, having corresponding function to the mechanism shown in FIG. 1*b*, in more detail. In FIG. 2*a*, the mechanism 240 is shown in the engaged configuration. A second idler gear 222B, corresponding to that shown in FIG. 1*b*, is shown. The selective engagement mechanism 240 has an input in the form of a toothed input gear 242 and an output in the form of a toothed output gear 244. A control system 245 is also provided, to control the output from the output gear 244. The control system 245 includes an intermediate gear 246, a connector 248, a spring (not shown), a spring retainer 250 and a locking arrangement 252.

The input gear 242 and output gear 244 are engaged to each other via the intermediate gear 246, which is toothed and which forms part of the control mechanism 245. Because of the coupling, the input 242 and output gears 244 rotate in the same sense, with the intermediate gear 246 rotating in the opposite sense between them.

The axis of rotation of the input gear 242 is fixed relative to the axis of rotation of the intermediate gear 246. The output gear 244 is coupled to the intermediate gear 246 by the connector 248 so as to allow rotation of the axis of rotation of the output gear 244 about the axis of rotation of the intermediate gear 246, while retaining engagement of the teeth of the gears 244, 248. The axis of rotation of the output gear 244 is then free to rotate about the intermediate gear 246, and the output gear 244 can move into and out of engagement with the second idler gear 222B. In this way, the output gear 244 moved into and out of engagement with the black ink transmission module (not shown).

The connector 248 is biased into frictional engagement with the intermediate gear 246 by the spring (not shown) and the spring retainer 250. The connector 248 is able to rotate relative to the intermediate gear 246 about the common axis of rotation. However, the frictional engagement causes the connector 248 to rotate with the intermediate gear 246 unless the connector 248 is constrained from moving, in which case the intermediate gear 246 rotates while the connector 248 does not.

The connector 248 also includes an engaging arm 251 on the opposite radial side of the output gear 244. The engaging arm 251 interacts with the locking arrangement 252 as described below.

The locking arrangement 252 is mounted in the mechanism 240. The locking arrangement 252 includes a toothed control gear 254, the axis of rotation of which is fixed in position relative to axes of rotation of the intermediate 246 and input gears 242. The control gear 254 is engaged with the intermediate gear 246 and rotates in the opposite sense to it, i.e. in the same sense as the input and output gears 242, 244. The locking arrangement 252 also includes a first cam 256 and a second cam 260, each mounted coaxially with the control gear 254, the first cam 256 being arranged between the control gear 254 and the second cam 260.

Figure 2B:
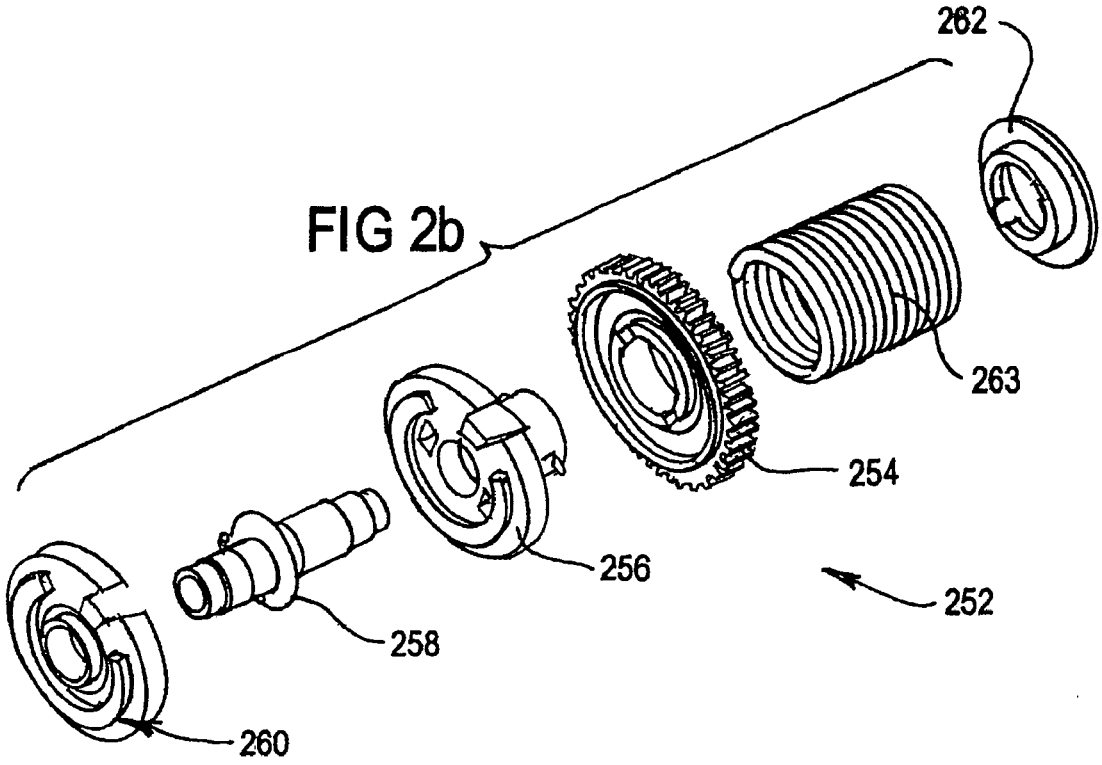
FIG. 2*b* shows an exploded view of a part of the mechanism shown in FIG. 2*a*, in accordance with an embodiment of the invention.

FIG. 2*b* shows an exploded view of the locking arrangement 252 of FIG. 2*a*, in more detail. The locking arrangement 252 has a toothed gear 254. The first cam 256 is mounted coaxially on one side of the gear 254 on a control shaft 258. Distal to the gear 254, on the same side as the first cam 256, the second cam 260 is coaxially mounted on the control shaft 358. The first and second cams 256, 260 can rotate relative to one another and to the gear 254. A portion of the first cam 256 extends through a central hole in the control gear 254 and engages a retainer 262 on the opposite side of the control gear 254. Between the control gear 254 and the retainer 262, a biasing member in the form of a first compression spring 263 is provided, to bias the gear 254 into frictional contact with the first cam 256.

Figure 2C:
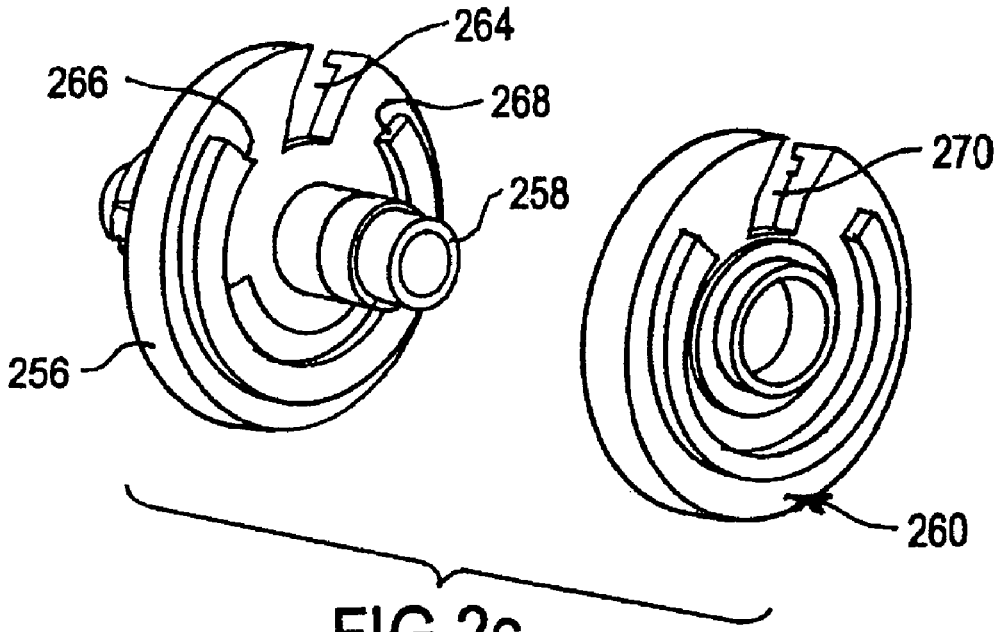
FIG. 2*c* shows parts from the view of FIG. 2*a* from a different perspective, in accordance with an embodiment of the invention.

FIG. 2*c* shows the first and second cams 256, 260 and the control shaft 258 of FIG. 2*b* in more detail. The first cam 256 has a recessed portion 264. It also has a first flange 266 and a second flange 268 extending away from the radial face, which, when mounted, is arranged away from the control gear 254. The second cam 260 also has a recess 270 of the same shape as that of the first cam 256.

Figure 2D:
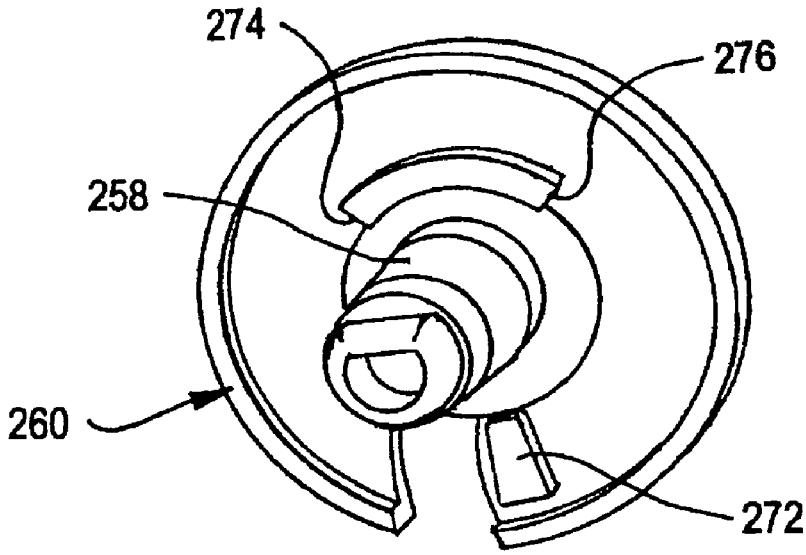
FIG. 2*d* shows a part from the view of FIG. 2*a* from a further different perspective, in accordance with an embodiment of the invention.

FIG. 2*d* shows the second cam 260, of the locking arrangement 252 shown in FIG. 2*b*, mounted on the control shaft 258. The figure shows a first side of the second cam 260, which faces along the axis of rotation of the second cam 260 towards the first cam. The second cam 260 has a raised tooth 272 protruding axially from the first side, the tooth 272 having first and second sides extending radially from the axis of rotation of the second cam 260.

The first and second flanges 266, 268 of the first cam 256 shown in FIG. 2*c* are arranged to have at least partially overlapping radial dimensions with the sides of the tooth 272 on the second cam 260, so that relative rotation of the first and second cams 256, 260 is only possible for a limited angle, i.e. until one of the flanges 266, 268 of the first cam 256 shown in FIG. 2*c* comes into abutment with the tooth 272 of the second cam 260.

As shown in FIG. 2*d*, the shaft 258 has stopping surfaces 274, 276 also arranged to have at least partially overlapping radial dimensions with the sides of the tooth 272 on the second cam 260. These prevent the second cam 260 from rotating when the raised tooth 272 comes into abutment with either of these stopping surfaces 274, 276 during rotation of the cams (not shown), 260. When the second cam 260 comes into engagement with one of the stopping surfaces 274, 276 on the shaft 270, both cams (not shown), 260 remain stationary until the control gear (not shown) rotates in the opposite sense. This occurs because a flange of the first cam (not shown) is in contact with the tooth 272 of the second cam 260. In this way, the cams (not shown), 260 do not accidentally over rotate and align their respective recesses when it is not desired.

Figure 2E:
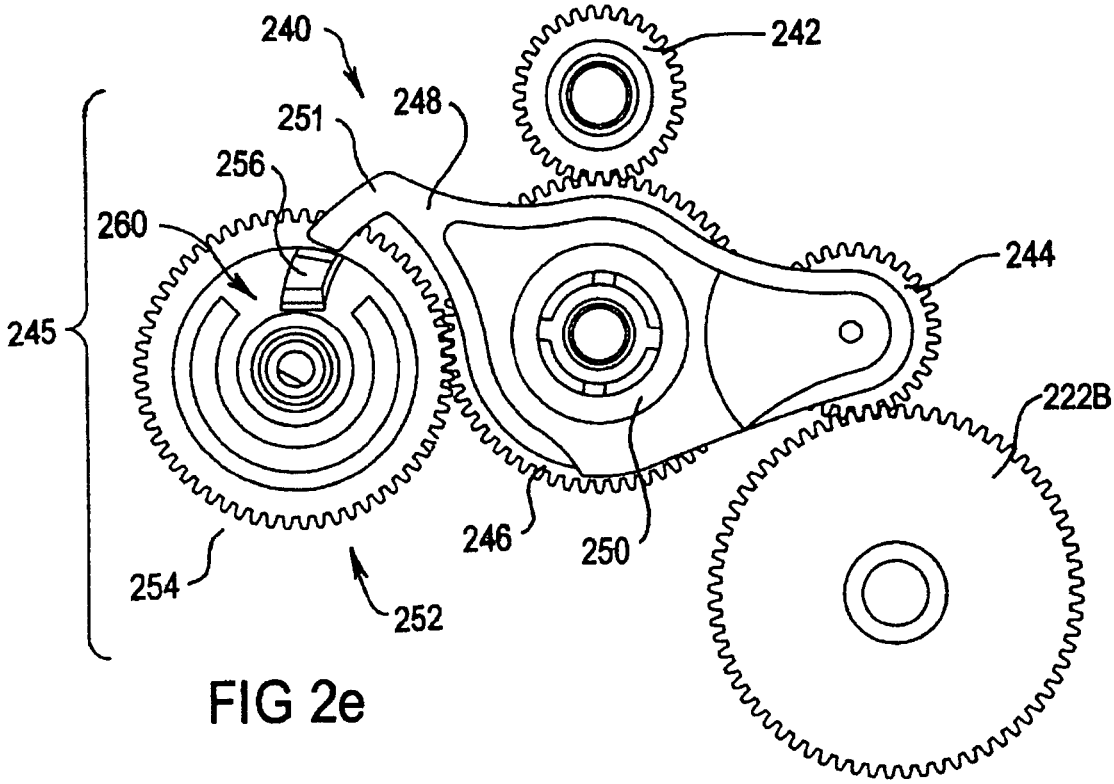
FIG. 2*e* shows detail of the mechanism of FIG. 2*a* in a second configuration in accordance with an embodiment of the present invention.
Figure 2F:
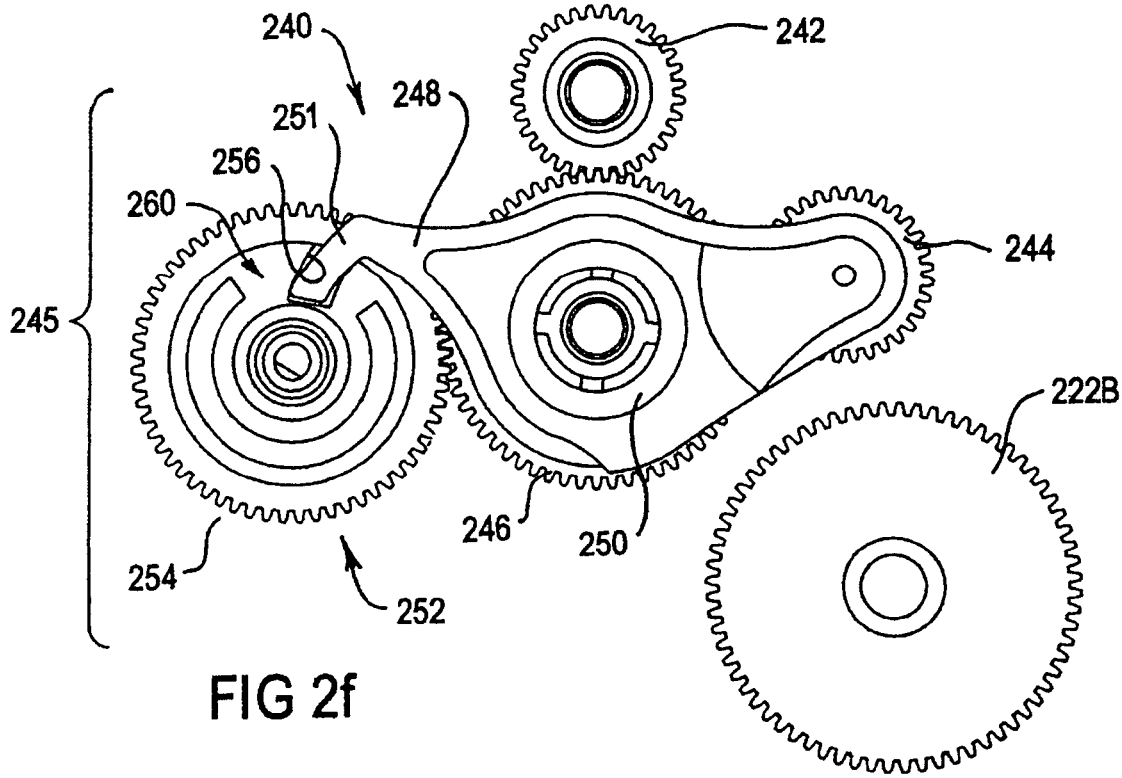
FIG. 2*f* shows detail of the mechanism of FIG. 2*a* in a third configuration in accordance with an embodiment of the present invention.

FIGS. 2*e* and 2*f* show the mechanism 240, and second idler gear 222B of FIG. 2*a* in different configurations, and charts 1 and 2, below, show the combination of rotations to engage and disengage the mechanism 240 respectively.

CHART 1

Sequence chart for combination lock module to engage transmission of black ink supply

| Motor | Status of lock module | Transmission module (Black) | Transmission modules (Color) |
|---|---|---|---|
| Turns anti-clockwise xx turns | Reset mode | Engaged from disengaged | Engaged |
| Turns clockwise whenever ink supply is required | Cam 2 remains stationary (rotates anti-clockwise with respect to the first cam) output is still engaged to module | Engaged | Engaged |

CHART 2

Sequence chart for combination lock to disengage transmission of black ink supply

| Motor | Status of lock module | Transmission module (Black) | Transmission modules (Color) |
|---|---|---|---|
| Turns anti-clockwise xx turns | Reset mode | Engaged | Engaged |
| Turns clockwise yy turns | Cam 2 turns clockwise, align indentation of Cam 2 with the level arm | Engaged | Engaged |
| Turns anti-clockwise zz turns | Cam 1 turns anti-clockwise, align indentation of Cam 1 with arm, Cam 2 stays still. | Engaged | Engaged |
| Turns clockwise aa turns | arm fits inside the indentations of both first and second cams, output disengages from module | Disengaged | Engaged |
| Turns clockwise whenever ink supply is required | Same as previous state | Disengaged | Engaged |

The operation of the control system of the mechanism of an embodiment will now be explained. Referring back to FIG. 2*a*, the figure shows the control system 245 of the mechanism 240 in the engaged configuration. FIGS. 2*e* and 2*f* show the control system 245 during disengagement. All parts shown in FIGS. 2*e* and 2*f* correspond to those shown in FIG. 2*a*.

In order to reset the mechanism 240, the input gear 242 is rotated anti-clockwise by more than one complete revolution. This ensures that the mechanism 240 is in the reset position where the second cam 260 is being rotated by abutment of the tooth of the second cam 260 with the second flange of the first cam 256 and where the two cams 256, 260 are therefore rotating together.

When the input gear 242 is rotated anti-clockwise, the intermediate gear 246 of the control system 245 is rotated clockwise, and the output gear 244 is urged towards the second idler gear 222B of the transmission module, so the output gear 244 will engage, if currently disengaged, and will then remain engaged. The input gear 242 is then rotated clockwise. The intermediate gear 246 rotates anti-clockwise, which urges the connector 248 to also rotate anti-clockwise.

However, the two cams 256, 260 are not aligned and the engaging arm 251 of the connector 248 cannot enter the recesses in the cams 256, 260, to disengage the output gear 244. The control gear 254 of the control system 245 is rotated clockwise by the intermediate gear 246, and the first cam 256 also rotates clockwise, due to the frictional contact with the control gear 254. The second cam 260 remains still, as the second flange of the first cam 256 is no longer abutting the tooth of the second cam 260, until the first flange of the first cam 256 comes into contact with the tooth of the second cam 260, and the second cam 260 then rotates with the first cam 256. At this point, the two cams 256, 260 are still not aligned, and continued clockwise rotation will result in transmission of the clockwise rotation from the color ink control shaft (not shown) to the black ink control shaft (not shown), for as long as the only rotation is clockwise. The color ink control shaft (not shown) may be stopped and restarted, and the mechanism 240 will remain engaged.

When a gear (not shown) coupled to the input gear 242 is rotated anti-clockwise, it rotates the input gear 242 of the mechanism 240 clockwise. The rotation of the input gear 242 causes the intermediate gear 246 to rotate anti-clockwise. The connector 248 cannot rotate anticlockwise with the intermediate gear 250 because the engaging arm 251 is abutting the locking arrangement 252. As the intermediate gear 246 rotates, the control gear 254 rotates the locking arrangement 252 as a single unit. Therefore, the arm 251 cannot extend into the recesses of the cams 256, 260 of the control system 245 because they are not aligned, and, rotating as one, will not become aligned. The output gear 244 is kept in engagement with the second idler gear 222B of the transmission module.

Therefore, when the gear (not shown) coupled to the input gear 242 is rotated anti-clockwise (causing clockwise rotation of the input gear 242), with the mechanism 240 engaged, the output gear 244 rotates clockwise, which rotates the second idler gear 222B anti-clockwise.

In order to disconnect the mechanism 240, after the resetting anti-clockwise rotation of the input gear 242, the input gear 242 is rotated clockwise, until the second cam 260 is rotating in clockwise, as described above. However, instead of continuing the clockwise rotation of the input gear 242, the input gear 242 is rotated clockwise by a predetermined angle that engages the second cam 260 to rotate clockwise, and then stops the rotation when the recess of the second cam 260 is aligned with the engaging arm 251 of the connector 248.

The input gear 242 is then rotated anti-clockwise again, which rotates the control gear 254 anticlockwise, together with the first cam 256, again due to the frictional contact between the two. The second cam 260 does not rotate, as the tooth of the second cam 260 is not abutting the first flange of the first cam 256. Before the second flange rotates around on the first cam 256 and abuts the tooth on the second cam 260, the first cam 256 passes the position in which it is aligned to receive the engaging arm 251 of the connector 248 in the recess. The rotation is stopped at this point.

The rotation is then reversed once more. The rotation of the input gear 242 in the clockwise direction causes the intermediate gear 246 to rotate anti-clockwise, and the connector 248 also rotates anticlockwise due to the frictional engagement of the two. The engaging arm 251 of the connector 248 therefore enters the aligned recesses of the first and second cams 256, 260, and the mechanism 240 disengages.

Now when the clockwise rotation of the input gear 242 is continued, the connector 248 is always rotated anti-clockwise, so pushing the engaging arm 251 of the connector 248 into the aligned recesses of the first and second cams 256, 260, and keeping the mechanism 240 in the disengaged configuration. When the mechanism 240 is in the disengaged configuration, the first and second cams 256, 260 do not rotate as they are held in position by the engaging arm 251 of the connector 248. The first cam 256 therefore slips against the control gear 254, overcoming the frictional engagement with it.

In the present embodiment, the gears of the mechanism 240 are sized so that, when used in the system of FIG. 1*b*, one revolution of the color ink control shaft (110 shown in FIG. 1*b*) provides one revolution of the control gear 254. In this way, when the mechanism 240 is used in the system shown in FIG. 1*b*, by sensing the rotation of the color ink control shaft 110 with the decoder (130 shown in FIG. 1*b*), the position of the control gear 254 is also known, as it will correspond to that of the color ink control shaft (110 shown in FIG. 1*b*).

The invention has been described above purely by way of example and modifications, omission, additions and substitutions can be made, which fall within the scope and spirit of the invention, the invention also extending to individual integers and groups of integers and their equivalents.

What is claimed is:

1. A mechanism for controlling at least one ink transmission module, which controls a supply of ink using received control rotation, the mechanism comprising:

an input, to receive control rotation;

an output, to selectively transfer the control rotation to the ink transmission module; and a control system, to control the selective transfer of the output, wherein the mechanism is moveable into a disengaged configuration by the control system, in which the output does not transfer rotation of the input to the ink transmission module, by a first predetermined sequence of rotations of the input, and into an engaged configuration, in which the output transfers rotation of the input to the ink transmission module, by a second predetermined sequence of rotations of the input.

2. A mechanism according to claim 1, wherein the input and output are toothed gears configured to rotate about respective mutually parallel axes.

3. A mechanism according to claim 2, the control system comprising:

an intermediate gear configured to rotate about an axis parallel to those of the input and output gears, the intermediate gear rotationally coupling the input and output gears;

a connector mounted rotatably, coaxially and in frictional engagement with the intermediate gear, the connector mounting the output gear in engagement with the intermediate gear so that the axis of rotation of the output gear can rotate about the axis of rotation of the intermediate gear, and the connector having an engaging arm; and a locking arrangement engaged with the intermediate gear, the locking arrangement being configurable to position the engaging arm of the connector, and therefore the connector, in a first position when the mechanism is in the engaged configuration, and a second position when the mechanism is in the disengaged configuration.

4. A mechanism according to claim 3, wherein the locking arrangement comprises:

a control gear, in fixed rotational engagement with the intermediate gear;

a first cam, mounted rotatably, coaxially, and in frictional engagement with the control gear; and a second cam, mounted rotatably and coaxially with the control gear, wherein the first and second cams each have a recess configured to receive the engaging arm of the intermediate gear when the cams are in a predetermined rotational position.

5. A mechanism according to claim 4, wherein the first cam comprises a pair of flanges extending substantially axially from one radial side thereof, and the second cam comprises a tooth extending from one side of the second cam, the tooth having a pair of substantially radially extending sides, wherein the flanges and sides of the tooth are configured to allow a predetermined relative angle of rotation between the first and second cams, before a flange abuts a side to cause the cams to rotate together.

6. A mechanism according to claim 1, wherein the mechanism is configured to move from disengaged position to the engaged position by rotation of the input in a first rotational direction.

7. A mechanism according to claim 6, wherein the mechanism is configured to retain the output in the engaged position during rotation in an opposite direction to the first direction, following the rotation in the first rotational direction.

8. A mechanism according to claim 1, wherein the mechanism is configured to move from the engaged position to the disengaged position by rotation of the input by a predetermined angle in a first rotational direction, followed by rotation by a predetermined angle in an opposite rotational direction, followed by rotation by a predetermined angle in the first rotational direction, allowing rotation in the opposite rotational direction with the mechanism disengaged.

9. A mechanism according to claim 8, wherein the mechanism is configured so that rotation of the input in the opposite rotational direction does not cause the mechanism to move from the disengaged position to the engaged position.

10. An ink delivery system for a printer, the ink delivery system comprising:

a first shaft to control a first set of transmission modules of a first set of ink delivery reservoirs;

a second shaft to control a second set of transmission modules of a second set of ink delivery reservoirs;

a mechanism to selectively rotationally couple the second control shaft to the first control shaft, the mechanism comprising:

an input, to receive ink transmission module control rotation;

an output, to selectively transfer the control rotation to the second shaft; and a control system, to control the selective transfer of the output, wherein the mechanism is moveable into a disengaged configuration by the control system, in which rotation of the input is not transferred to the second shaft via the output, by a first predetermined sequence of rotations of the input, and into an engaged configuration, in which rotation of the input is transferred to the second shaft via the output, by a second predetermined sequence of rotations of the input.

11. An ink delivery system according to claim 10, further comprising a motor connected to the first shaft for rotating said shaft about its axis.

12. An ink delivery system according to claim 10, further comprising at least one idler gear via which the output is coupled to the second shaft.

13. An ink delivery system for a printer, comprising:

a first shaft for controlling a first set of transmission modules for at least one ink delivery reservoir;

a second shaft for controlling a second set of transmission modules for at least one further ink delivery reservoir;

a mechanism for selectively rotationally coupling the second shaft to the first control shaft, the mechanism comprising:

an input gear, to receive ink transmission module control rotation;

an output gear, selectively coupled to the second control shaft, to selectively transfer the control rotation to the second shaft; and a control system, to control the selective transfer of the output gear, wherein the mechanism is moveable into a disengaged configuration by the control system, in which rotation of the input gear is not transferred to the second shaft via the output gear, by a first predetermined sequence of rotations of the input gear, and into an engaged configuration, in which rotation of the input gear is transferred to the second shaft via the output gear, by a second predetermined sequence of rotations of the input gear, wherein the control system comprises:

an intermediate gear configured to rotate about an axis parallel to axes of rotation of the input and output gears, the intermediate gear rotationally coupling the input and output gears;

a connector mounted rotatably, coaxially and in frictional engagement with the intermediate gear, the connector mounting the output gear in engagement with the intermediate gear so that the axis of rotation of the output gear can rotate about the axis of rotation of the intermediate gear, and the connector having an engaging arm; and a locking arrangement engaged with the intermediate gear, the locking arrangement being configurable to position the engaging arm of the connector, and therefore the connector, in a first position when the mechanism is in the engaged configuration, and a second position when the mechanism is in the disengaged configuration.

14. An ink delivery system according to claim 13, further comprising at least one idler gear via which the output gear is coupled to the second shaft.

15. An ink delivery system for a printer, the system comprising:

an ink supply control motor;

an ink transmission module configured to activate and deactivate an ink supply by rotational input;

a selective engagement mechanism, the mechanism having:

an input gear, coupled to the motor to be rotated thereby;

an output gear, to selectively transfer the control rotation to the ink transmission module; and a control system, to control the selective transfer of the output gear, wherein the mechanism is moveable into a disengaged configuration by the control system, in which rotation of the input gear is not transferred to the second shaft via the output gear, by a first predetermined sequence of rotations of the input gear, and into an engaged configuration, in which rotation of the input gear is transferred to the second shaft via the output gear, by a second predetermined sequence of rotations of the input gear.

16. An ink delivery system for a printer, the system comprising:

an ink supply control motor;

an ink transmission module configured to activate and deactivate an ink supply by rotation;

a selective engagement mechanism, the mechanism having:

an input gear coupled to the motor to be rotated thereby;

an output gear, selectively coupled to the ink transmission module, to selectively transfer the control rotation to the ink transmission module; and a control system, to control the selective transfer of the output gear, wherein the mechanism is moveable into a disengaged configuration by the control system, in which the output gear does not transfer rotation of the input gear to the ink transmission module, by a first predetermined sequence of rotations of the input gear, and into an engaged configuration, in which the output gear transfers rotation of the input gear to the ink transmission module, by a second predetermined sequence of rotations of the input gear, wherein the control system comprises:

an intermediate gear configured to rotate about an axis parallel to axes of rotation of the input and output gears, the intermediate gear rotationally coupling the input and output gears;

a connector mounted rotatably, coaxially and in frictional engagement with the intermediate gear, the connector mounting the output gear in engagement with the intermediate gear so that the axis of rotation of the output gear can rotate about the axis of rotation of the intermediate gear, and the connector having an engaging arm; and a locking arrangement engaged with the intermediate gear, the locking arrangement being configurable to position the engaging arm of the connector, and therefore the connector, in a first position when the mechanism is in the engaged configuration, and a second position when the mechanism is in the disengaged configuration.

17. An ink delivery system for a printer, the system comprising:

ink supply control means;

ink transmission means for activating and deactivating an ink supply by rotation;

selective engagement means having:

input means coupled to the motor for rotation thereby;

output means for selectively transferring the control rotation to the ink transmission means; and control means for controlling the selective transfer of the output means, wherein the selective engagement means is moveable into a disengaged configuration by the control means, in which rotation of the input means is not transferred to the ink transmission means via the output means, by a first predetermined sequence of rotations of the input means, and into an engaged configuration, in which rotation of the input means is transferred to the ink transmission means via the output means, by a second predetermined sequence of rotations of the input means, wherein the control means comprises:

an intermediate means for rotating about an axis parallel to axes of rotation of the input means and output means, the intermediate means being for rotationally coupling the input means and output means;

connecting means mounted rotatably, coaxially and in frictional engagement with the intermediate means, the connecting means being for mounting the output means in engagement with the intermediate means so that the axis of rotation of the output means can rotate about the axis of rotation of the intermediate means, and the connecting means having an engaging means; and locking means engaged with the intermediate means, the locking means being for positioning the engaging means of the connecting means, and therefore the connecting means, in a first position when the selective engagement means is in the engaged configuration, and a second position when the selective engagement means is in the disengaged configuration.

* * * * *